US010832505B2

(12) United States Patent
McNally et al.

(10) Patent No.: US 10,832,505 B2
(45) Date of Patent: Nov. 10, 2020

(54) PROCESSING VIDEO AND SENSOR DATA ASSOCIATED WITH A VEHICLE

(71) Applicant: Cosworth Group Holdings Limited, Northampton (GB)

(72) Inventors: Luke McNally, Northampton (GB); Melfyn Roberts, Northampton (GB); Mark Taylor, Northampton (GB)

(73) Assignee: COSWORTH GROUP HOLDINGS LIMITED (GB)

( * ) Notice: Subject to any disclaimer, the term of this patent is extended or adjusted under 35 U.S.C. 154(b) by 283 days.

(21) Appl. No.: 15/101,557

(22) PCT Filed: Dec. 5, 2014

(86) PCT No.: PCT/GB2014/053629
§ 371 (c)(1),
(2) Date: Jun. 3, 2016

(87) PCT Pub. No.: WO2015/082941
PCT Pub. Date: Jun. 11, 2015

(65) Prior Publication Data

US 2016/0307378 A1 Oct. 20, 2016

(30) Foreign Application Priority Data

Dec. 6, 2013 (GB) ..... 1321626.2
Jan. 5, 2014 (GB) ..... 1400110.1

(51) Int. Cl.
*G07C 5/08* (2006.01)

(52) U.S. Cl.
CPC ..... *G07C 5/0866* (2013.01)

(58) Field of Classification Search
CPC ..... G07C 5/0866; G07C 5/08
See application file for complete search history.

(56) References Cited

U.S. PATENT DOCUMENTS 5,003,317 A * 3/1991 Gray ..... G01S 5/0009 342/457
8,768,604 B1 * 7/2014 Klimek ..... G08G 1/13 340/988

(Continued)

FOREIGN PATENT DOCUMENTS

FR 2 917 204 A1 12/2008
JP 2006 211415 A 8/2006

OTHER PUBLICATIONS

International Search Report (ISR) dated Jun. 5, 2015, Application No. PCT/GB2014/053629, 6 pages.
English Abstract, JP 2006 211415 A, 2 pages.

*Primary Examiner* — Maria E Vazquez Colon
(74) *Attorney, Agent, or Firm* — Ware, Fressola, Maguire & Barber LLP

(57) ABSTRACT

Processing video and sensor data associated with a vehicle Apparatus (5) is configured to: obtain first data corresponding to video data from a video camera (6) associated with a vehicle; obtain second data corresponding to sensor data from one or more sensors (8) associated with the vehicle; form a data structure including metadata and the first and second data, wherein first timing information for the first data is included in the metadata and second timing information for the second data is included in the second data, wherein the first and second timing information enable the first and second data to be temporally related.

20 Claims, 8 Drawing Sheets

(56) References Cited

U.S. PATENT DOCUMENTS

| | | | | |
|---|---|---|---|---|
| 2004/0135677 | A1* | 7/2004 | Asam | A63F 13/12 340/425.5 |
| 2006/0038818 | A1* | 2/2006 | Steele | H04N 21/235 345/440 |
| 2010/0185362 | A1 | 7/2010 | Vialatte et al. | |
| 2011/0126250 | A1* | 5/2011 | Turner | H04N 5/76 725/109 |
| 2012/0257765 | A1* | 10/2012 | Koehler | H04H 20/04 381/77 |
| 2013/0282773 | A1 | 10/2013 | Lee | |
| 2017/0221381 | A1* | 8/2017 | Tamir | G06Q 30/0283 |

* cited by examiner

PROCESSING VIDEO AND SENSOR DATA ASSOCIATED WITH A VEHICLE

FIELD

The present invention relates to processing video and sensor data associated with a vehicle.

BACKGROUND

Obtaining and analysing data from, for example, video cameras, positioning systems and certain other sensors associated with a vehicle is useful in assessing driver performance in the context of motorsport or everyday driving. Devices are known which can record video, and log global positioning system (GPS) and controller area network (CAN) bus data. Means for playing back such data are also known.

SUMMARY

According to first and second aspects of the present invention, there is provided, respectively, a method as specified in claim 1 and apparatus as specified in claim 12.

Thus, the first and second aspects of the present invention can enable sensor data to be stored efficiently and/or with suitably precise timing information in the same data structure as video data which is stored in a form suitable for playback of the video. Moreover, the sensor data and the video data can still be temporally related, facilitating assessment of driver performance.

The one or more sensors associated with the vehicle include one or more sensors which are neither video nor audio sensors.

According to third and fourth aspects of the present invention, there is provided, respectively, a method as specified in claim 23 and apparatus as specified in claim 35.

Thus, the third and fourth aspects of the present invention can enable first data associated with a vehicle and second data associated with a vehicle to be played back in such a way as to facilitate comparisons between the first and second data.

Optional features of the present invention are specified in the dependent claims.

BRIEF DESCRIPTION OF THE DRAWINGS

Certain embodiments of the present invention will be described, by way of example, with reference to the accompanying drawings, in which.

DETAILED DESCRIPTION OF THE CERTAIN EMBODIMENTS

Figure 1:
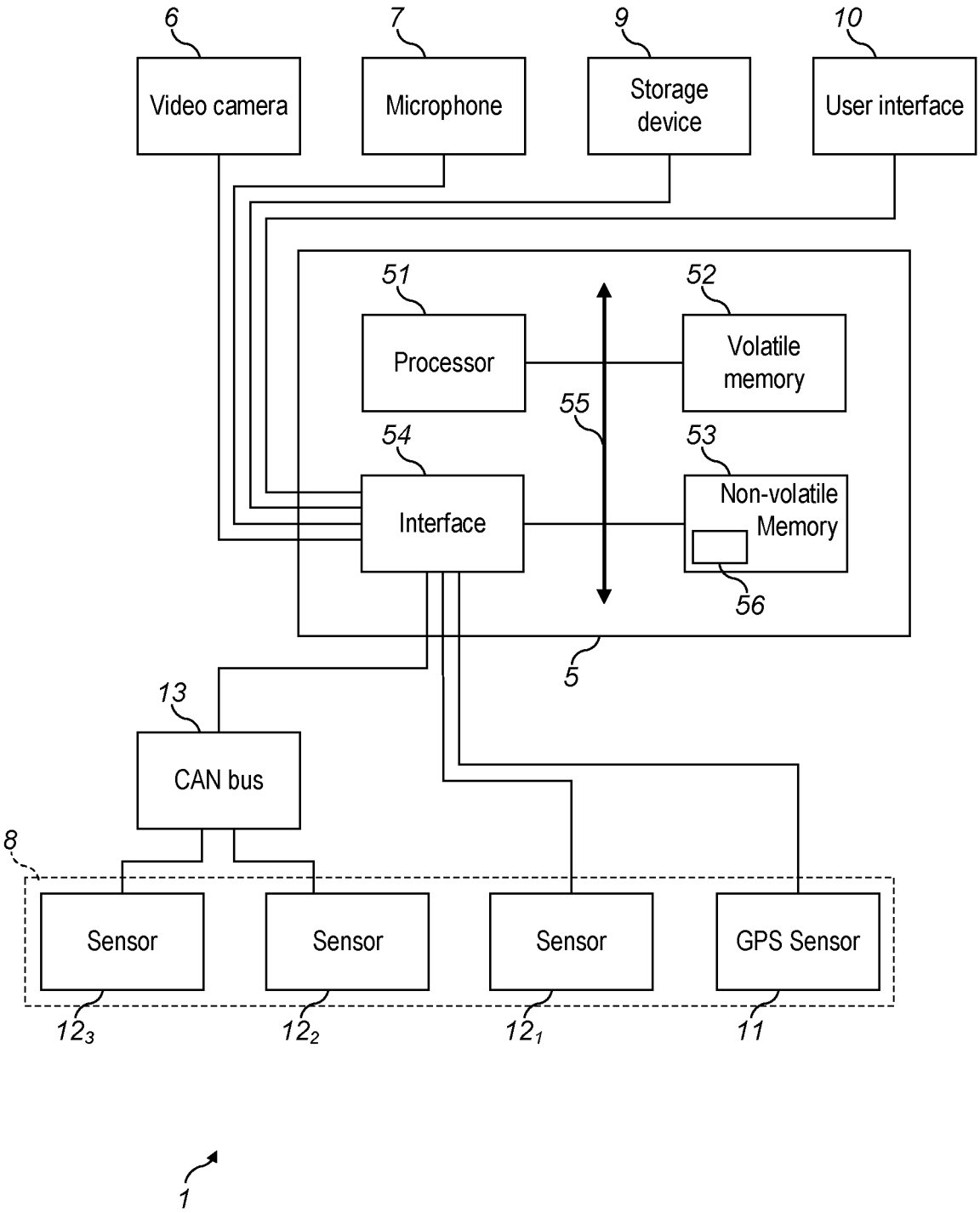
FIG. 1 illustrates a system in which are processed video, audio and sensor data associated with a vehicle.

Referring to FIG. 1, a system 1 according to a certain embodiment of the present invention will now be described. The system 1 can be included in a vehicle (not shown), for example a car. The system 1 includes a data processor 5, a video camera 6, a microphone 7, four sensors 8, a storage device 9 and a user-interface 10. The sensors 8 include a GPS sensor 11 and three other sensors 12, two of which are connected to a CAN bus 13. In certain other embodiments, the system 1 may include different numbers of certain elements, particularly those indicated by the reference numbers 6, 7, 8, 9, 10, 11, 12, 13, and/or need not include certain elements, particularly those indicated by the reference numbers 7, 10, 11, 12, 13.

The data processor 5 preferably corresponds to a microcontroller, a system on a chip or a single-board computer. The data processor 5 includes a processor 51, volatile memory 52, non-volatile memory 53, and an interface 54. In certain other embodiments, the data processor 5 may include a plurality of processors 51, volatile memories 52, non-volatile memories 53 and/or interfaces 54. The processor 51, volatile memory 52, non-volatile memory 53 and interface 54 communicate with one another via a bus or other form of interconnection 55. The processor 51 executes computer-readable instructions 56, e.g. one or more computer programs, for performing certain methods described herein. The computer-readable instructions 56 are stored in the non-volatile memory 53. The interface 54 is operatively connected to the video camera 6, the microphone 7, the sensors 8 (via the CAN bus 13 where appropriate), the storage device 9 and the user interface 10 to enable the data processor 5 to communicate therewith. The data processor 5 is provided with power from a power source (not shown), which may include a battery.

The video camera 6 is preferably arranged to provide a view similar to that of a driver in a normal driving position, and the microphone 7 is preferably arranged in the interior of the vehicle. However, the video camera 6 and/or microphone may be arranged differently. The microphone 7 may be integral with the video camera 6.

The GPS sensor 11 includes an antenna (not shown) and a GPS receiver (not shown). In certain other embodiments, the system 1 may include one or more other types of positioning system devices as an alternative to, or in addition to, the GPS sensor 11.

The other sensors 12 preferably include one or more of the following: an engine control unit (ECU), a transmission control unit (TCU), an anti-lock braking system (ABS), a body control module (BCM), a sensor configured to measure engine speed, a sensor configured to measure vehicle speed, an oxygen sensor, a brake position or pressure sensor, an accelerometer, a gyroscope, a pressure sensor and any other sensor associated with the vehicle. Each of these other sensors 12 may be connected to the interface 54 via the CAN bus 13 or not.

The storage device 9 preferably includes a removable storage device, preferably a solid-state storage device. In certain other embodiments, a communications interface for communicating with a remote device may be provided as an alternative to, or in addition to, the storage device 9.

The user interface 10 preferably includes a user input (not shown), a display (not shown) and/or a loudspeaker (not shown). In certain other embodiments, the user interface 10 may share common elements with an in-car entertainment system. The user interface 10 is configured to enable a user to control operations of the data processor 5, for example to set options, and start and stop the obtaining (i.e. recording) of data by the data processor 5. The user interface 10 is also preferably configured to enable a user to view the data obtained by the data processor 5, for example to view the video data and the sensor data in a suitable form.

Figure 2:
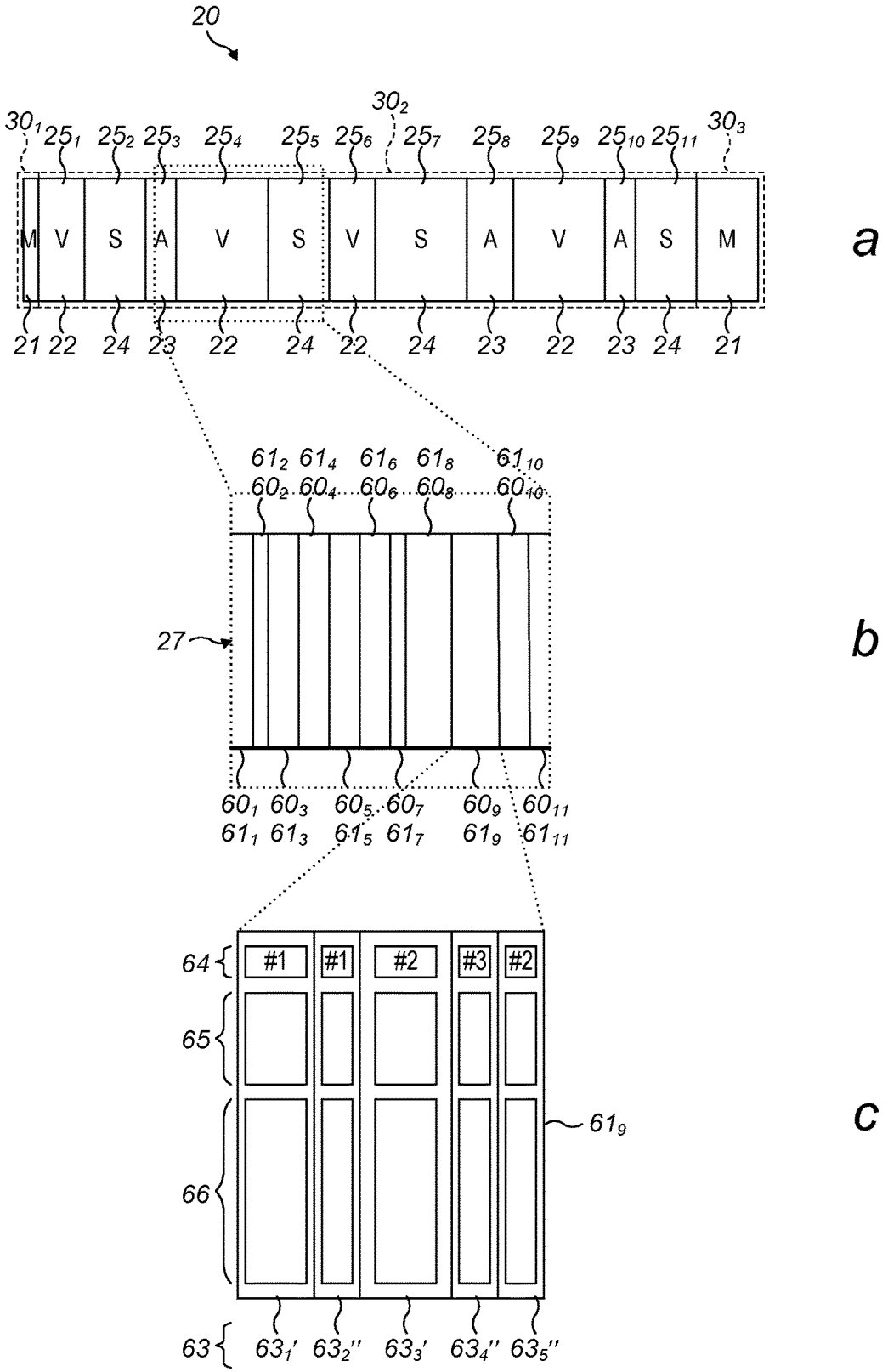
FIG. 2*a* illustrates a data structure formed by the system of FIG. 1.
FIG. 2*b* illustrates a part of the data structure of FIG. 2*a* in more detail.
FIG. 2*c* illustrates a part of the data structure of FIG. 2*b* in more detail.

As will be explained in more detail below, the data processor 5 is configured to obtain data from the video camera 6, microphone 7 and sensors 8, and to store corresponding data 22, 23, 24 (FIG. 2*a*) in a data structure 20 (FIG. 2*a*) in the storage device 9. The data 22, 23, 24 corresponding to the data obtained from the video camera 6, microphone 7 and sensors 8 is hereinafter referred to as "video data", "audio data" and "sensor data" respectively. The data 22, 23, 24 can then be analysed, for example using a computer running a suitable computer program (hereinafter referred to as a "data reader"), to assess driver performance.

Referring particularly to FIG. 2*a*, the data structure 20 will now be described. The data structure 20 includes some of the same elements as an MPEG-4 Part 14 ("MP4") file, as described in International Standards ISO/IEC 14496-12: 2008, "Information technology—Coding of audio-visual objects—Part 12: ISO base media file format" and ISO/IEC 14496-14:2003, "Information technology—Coding of audio-visual objects—Part 14: MP4 file format". The first of these documents is hereinafter referred to simply as "ISO/IEC 14496-12". The data structure 20 is preferably such that it can be processed by a data reader operating according to the MPEG-4 Part 14 standard.

The data structure 20 includes metadata 21 (denoted by the letter "M" in the figure), video data 22 ("V"), audio data 23 ("A") and sensor data 24 ("S"). In certain other embodiments, the data structure 20 does not include audio data 23. The metadata 21, video data 22, audio data 23 and sensor data 24 are contained in a plurality of objects called boxes 30, which will be described in more detail below. Certain metadata 21 is contained in a first box $\mathbf{30}_1$, namely a File Type box. The video data 22, audio data 23 and sensor data 24 are contained in a second box $\mathbf{30}_2$, namely a Media Data box $\mathbf{30}_2$. The remaining metadata 21 is contained in a third box $\mathbf{30}_3$, namely a Movie box. In certain other embodiments, at least some of the video data 22, audio data 23 and sensor data 24 may be included in a further Media data box and/or in a separate data structure. The data structure 20, and, in particular, the Media Data box $\mathbf{30}_2$, contains a plurality of a discrete portions $\mathbf{25}_1 \ldots \mathbf{25}_{11}$, each discrete portion consisting of either video data 22, audio data 23 or sensor data 24. Thus, the method for forming (and for reading) the data structure 20 can be more efficient (e.g. in terms of memory and/or processor usage). In the example illustrated in the figure, there are 11 discrete portions $\mathbf{25}_1 \ldots \mathbf{25}_{11}$ arranged in a certain order. However, in other examples, there may be any number of discrete portions 25 arranged in any order. There may be a multiplicity, e.g. hundreds, of discrete portions 25.

Referring particularly to FIG. 2*b*, the video data 22, audio data 23 and sensor data 24 will now be described in more detail. The video data 22, audio data 23 and sensor data 24 can be collectively referred to as media data 27. In each discrete portion 25, the media data 27 is stored in a series of Chunks 60, and each Chunk 60 consists of one or more Samples 61. In this example, each Chunk 60 consists of only one Sample 61. However, this need not be the case. Each Chunk 60 begins at a certain absolute location in the data structure 20.

The video data 22 is preferably stored in the data structure 20 in H.264/MPEG-4 Part 10 or, in other words, Advanced Video Coding (AVC) format, and the audio data 23 is preferably stored in the data structure 20 in Advanced Audio Coding (AAC) format. However, the video data 22 and/or the audio data 23 may be stored in different formats.

Referring particularly to FIG. 2*c*, the sensor data 24 will now be described in more detail. Each Sample 61 of the sensor data 24 includes one or more readings 63. In the Sample $\mathbf{61}_9$ illustrated in the figure, there are five readings 63. However, there may be any number of one or more readings 63 (each of which may be a full reading 63' or a compact reading 63"). Each reading 63 includes a channel number 64, an actual reading 65 and a timestamp 66. A reading 63 may correspond to a full reading 63', which has a length of 16 bytes, or a compact reading 63", which has a length of 8 bytes. The first two bits of the reading 63 indicates whether the reading 63 is a full reading 63' or a compact reading 63". The format of a full reading 63' is shown in Table 1, together with a description of the elements thereof.

TABLE 1

The full reading 63'.

| Byte(s) | Bits | Field | Description |
|---|---|---|---|
| 0 | 0, 1 | Reading type | 11 indicates that the reading is a full reading. |
| | 2 | Validity Flag | Reserved for future use. |
| | 3-7 | Channel Number | Identifies the channel to which the reading applies. |
| 1-3 | All | | |
| 4-7 | All | Reading | The reading value. |
| 8-15 | All | Timestamp | The time at which the reading was recorded. |

The format of a compact reading 63" is shown in Table 2, together with a description of the elements thereof.

TABLE 2

The compact reading 63'.

| Byte(s) | Bits | Field | Description |
|---|---|---|---|
| 0 | 0, 1 | Reading type | 01 indicates that the reading is a compact reading. |
| | 2-7 | Channel Number Offset | Identifies the channel to which the reading applies. This value is relative to the channel number from the preceding reading. |
| 1-3 | All | Reading Offset | The reading value, relative to the value from the preceding reading for the same channel. |
| 4-7 | All | Timestamp Offset | The time at which the sample was recorded, relative to the timestamp of the preceding reading. |

In normal circumstances, the majority of the readings 63 can be compact readings 63', thereby minimising the amount of memory and storage space required for the sensor data 24.

As will be explained in more detail below, each channel number is associated with a particular sensor 8 being the origin of the actual reading 65 (or with a particular type of reading from a sensor 8). Each Sample 61 can contain readings 63 associated with any one or more channels numbers in any order. Thus, the method for forming the data structure 20 can be more efficient (e.g. in terms of memory and/or processor usage). By way of example, the Sample $\mathbf{61}_9$ illustrated in the figure contains a first, full reading $\mathbf{63}_1'$ associated with a first channel ("#1"), a second, compact reading $\mathbf{63}_2''$ associated with the first channel ("#1"), a third, full reading $\mathbf{63}_3'$ associated with a second channel ("#2"), a fourth, compact reading $\mathbf{63}_4''$ associated with a third channel ("#3") and fifth, compact reading $\mathbf{63}_5''$ associated with the second channel ("#2").

Figure 3:
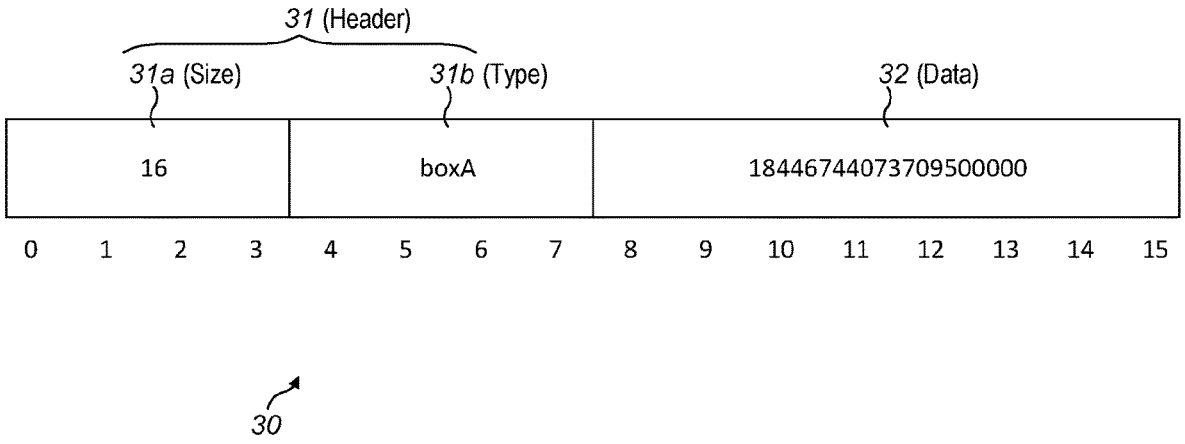
FIG. 3 illustrates a box which is a constituent of the data structure of FIG. 2*a;*

Referring particularly to FIG. 3, the structure of a box 30 will now be described in more detail. A box 30 consists of, firstly, a header 31 and, secondly, data 32. The header 31 consists of a first, four-byte field 31*a* to indicate the size of the box 30 (including the header 31 and the data 32) and then a second, four-byte (four-character) field 31*b* to indicate the type of the box 30. In the example illustrated in the figure, the box has a size of 16 bytes and has a type "boxA". A box 30 may contain one or more other boxes 30, in which case the size indicated in the header 31*a* of the box 30 includes the size of the other one or more boxes 30.

Figure 4:
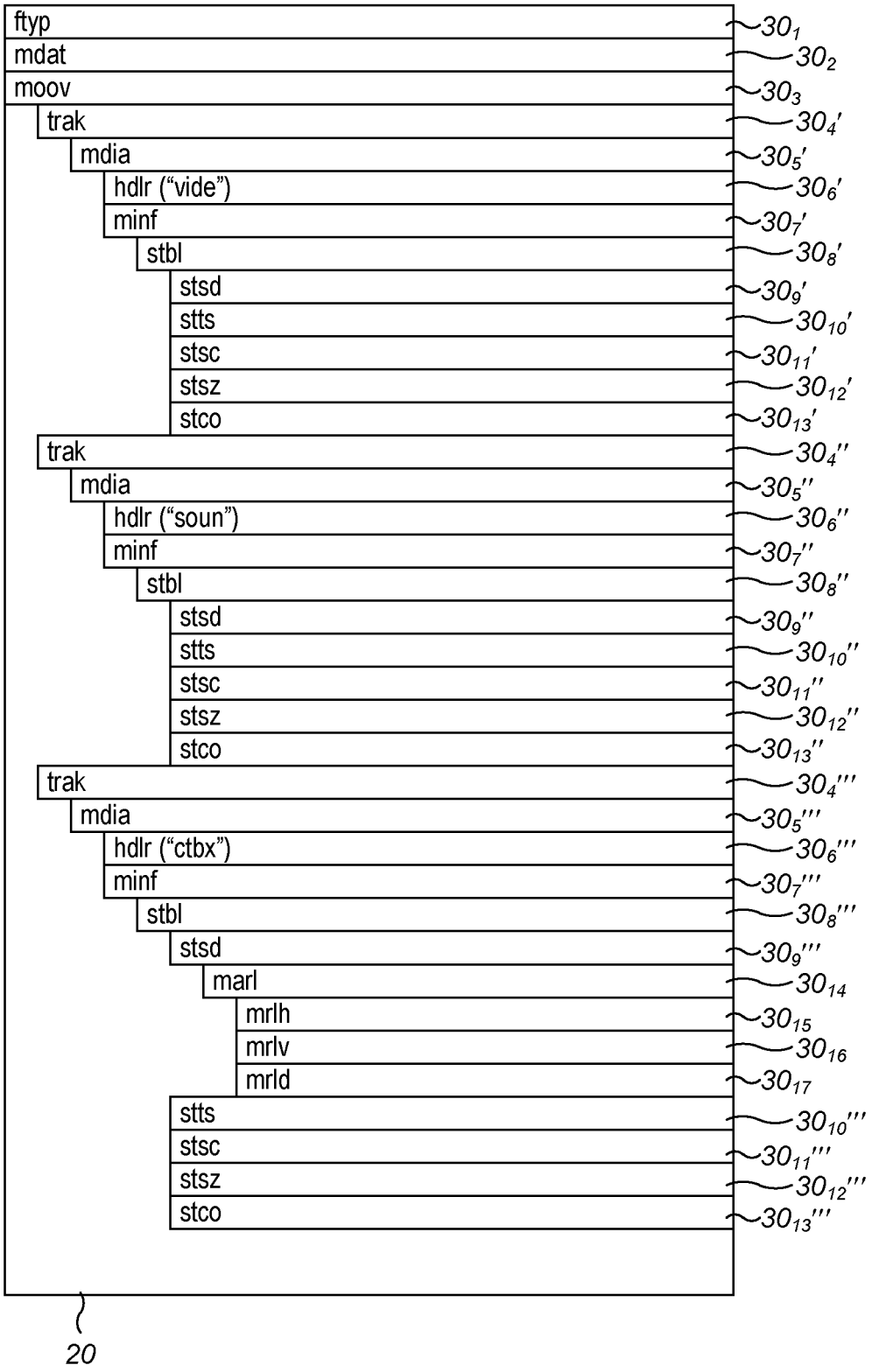
FIG. 4 illustrates, in another way, the data structure of FIG. 2*a;*

Referring particularly to FIG. 4, the metadata 21 will now be described in more detail. As explained above, certain metadata 21 is included in the File Type ("ftyp") box $\mathbf{30}_1$ and the remaining metadata 21 is included in the Movie ("moov") box $\mathbf{30}_3$.

The File Type box $\mathbf{30}_1$ is preferably or necessarily the first box 30 in the data structure 20. The boxes 30 other than the File Type box $\mathbf{30}_1$ can generally be included in the data structure 20, or in the box 30 in which they are included, in any order. The File Type box $\mathbf{30}_1$ provides information which may be used by a data reader to determine how best to handle the data structure 20.

The Movie box $\mathbf{30}_3$ contains several boxes which are omitted from the figure for clarity. For example, the Movie box $\mathbf{30}_3$ contains a Movie Header ("mvhd") box (not shown), which indicates, amongst other things, the duration of the movie.

Reference is made to ISO/IEC 14496-12 for information about the boxes 30 and the content of boxes 30 not described in detail herein.

The Movie box $\mathbf{30}_3$ contains first, second and third Track ("trak") boxes $\mathbf{30}_4'$, $\mathbf{30}_4''$, $\mathbf{30}_4''$. The first Track box $\mathbf{30}_4'$ includes metadata 21 relating to the video data 22, the second Track box $\mathbf{30}_4''$ includes metadata 21 relating to the audio data 23, and the third Track box $\mathbf{30}_4'''$ includes metadata 21 relating to the sensor data 24. Each Track box $\mathbf{30}_4$ contains, amongst other boxes (not shown), a Media ("mdia") box $\mathbf{30}_5$ Each Media box $\mathbf{30}_5$ contains, amongst other boxes (not shown), a Handler Reference ("hdlr") box $\mathbf{30}_6$ and a Media Information ("minf") box $\mathbf{30}_7$.

Each Handler Reference ("hdlr") box $\mathbf{30}_6$ indicates the nature of the data 22, 23, 24 to which the metadata 21 in the Track box $\mathbf{30}_4$ relates, and so how it should be handled. The Handler Reference boxes $\mathbf{30}_6'$, $\mathbf{30}_6''$, $\mathbf{30}_6'''$ in the first, second and third Track ("trak") boxes $\mathbf{30}_4'$, $\mathbf{30}_4''$, $\mathbf{30}_4'''$ includes the codes "vide", "soun" and "ctbx", respectively, indicative of video data 22, audio data 23 and sensor data 24, respectively. The first two of these codes are specified in ISO/IEC 14496-12.

Each Media Information ("minf") box $\mathbf{30}_7$ contains, amongst other boxes (not shown), a Sample Table ("stbl") box $\mathbf{30}_8$. Each Sample Table ("stbl") box $\mathbf{30}_8$ contains, amongst other boxes (not shown), a Sample Description ("stsd") box $\mathbf{30}_9$, a Decoding Time to Sample ("stts") box $\mathbf{30}_{10}$, a Sample To Chunk ("stsc") box $\mathbf{30}_{11}$, a Sample Size ("stsz") box $\mathbf{30}_{12}$ and a Chunk Offset ("stco") box $\mathbf{30}_{13}$.

In the first and second (video and audio data) Track boxes $\mathbf{30}_4'$, $\mathbf{30}_4''$, the Sample Description boxes $\mathbf{30}_9'$, $\mathbf{30}_9''$ includes information about the coding type used for the video data 22 and audio data 23, respectively, and any initialization information needed for that coding. In the third (sensor data) Track box $\mathbf{30}_4'''$, the Sample Description box $\mathbf{30}_9'''$ contains a Custom ("marl") box $\mathbf{30}_{14}$, which will be described in more detail below.

In brief, the remaining boxes $\mathbf{30}_{10}$, $\mathbf{30}_{11}$, $\mathbf{30}_{12}$ in the Sample Table box $\mathbf{30}_8$ provide a series of lookup tables to enable a data reader to determine the Sample 61 associated with a particular time point and the location of the Sample 61 within the data structure 20.

In more detail, the Decoding Time to Sample box $\mathbf{30}_{10}$ enables a data reader to determine the times at which Samples 61 must be decoded. In the case of the sensor data 24, the Decoding Time to Sample box $\mathbf{30}_{10}$ need not be used. The Sample to Chunk box $\mathbf{30}_{11}$ enables a data reader to determine which Chunk 60 contains each of the Samples 61. As explained above, in this example, each Chunk 60 contains one Sample 61. The Sample Size box $\mathbf{30}_{12}$ enables a data reader to determine the sizes of the Samples 61. The Chunk Offset box $\mathbf{30}_{13}$ enables a data reader to determine the absolute locations of the Chunks 60 in the data structure 20.

The Custom box $\mathbf{30}_{14}$ contains a Header ("mrlh") box $\mathbf{30}_{15}$, a Values ("mrlv") box $\mathbf{30}_{16}$ and a Dictionary ("mrld") box $\mathbf{30}_{17}$.

The Header box $\mathbf{30}_{15}$ is to enable a data reader to determine whether they are compatible with the sensor data 24 in the data structure 20. Implementations must not read data from a major version they do not understand. The format of the Header box $\mathbf{30}_{15}$ is shown in Table 3. In the tables, the offset is relative to the start of the data 32 in the box 30.

TABLE 3

The format of the Header box $30_{15}$.

| Field | Offset (bytes) | Size (bytes) | Type |
|---|---|---|---|
| Major Version | 0 | 2 | UInt16 |
| Minor Version | 2 | 2 | UInt16 |

The Values box $\mathbf{30}_{16}$ includes metadata 21 relating to the recording as whole, such as the time and date of the recording, and the language and measurements units selected. The Values box $\mathbf{30}_{16}$ has a variable size. The Values box consists of zero or one or more blocks, each of which includes a field for the name of the metadata 21, a field for a code ("type code") indicating the type of the metadata 21, and a field for the value of the metadata 21. The format of the block is shown in Table 4.

TABLE 4

The constituent block of the Values box

| Field | Size (bytes) | Type |
|---|---|---|
| Name | 4 | UInt32 |
| Type Code | 4 | UInt32 |
| Value | Variable | Variable |

The size and data type of the value field depends upon the type of metadata 21 in the block, as shown in Table 5.

TABLE 5

Sizes and data types of the value field associated with different type codes

| Type Code | Description | Size (bytes) | Data Type |
|---|---|---|---|
| 'strs' | Short string | 64 | String |
| 'lang' | Short string | 64 | String |
| 'strl' | Long string | 256 | String |
| 'time' | Time (ISO 86301) | 32 | String |
| 'date' | Date (ISO 86301) | 32 | String |
| 'tmzn' | Time zone (ISO 86301) | 32 | String |
| 'tstm' | Number of 100 nanosecond periods since the UTC epoch (Midnight, Jan. 1st, 1970). | 8 | UInt64 |
| 'focc' | A FourCC (four character code) | 4 | FourCC |
| 'kvp' | Key-value pair | 320 | Key-Value Pair |

The format of a key-value pair is shown in Table 6.

TABLE 6

The format of a key-value pair.

| Field | Size (bytes) | Type |
|---|---|---|
| Key | 64 | String |
| Value | 256 | String |

The Dictionary box $\mathbf{30}_{17}$ contains metadata 21 relating to each of the channel numbers in use. As explained above, each channel number is associated with a particular sensor 8 (or a particular type of reading from a sensor 8). The format of the Dictionary box $\mathbf{30}_{17}$ shown in Table 7.

TABLE 7

The format of the Dictionary box $30_{17}$.

| Field | Description | Offset (bytes) | Size (bytes) | Type |
|---|---|---|---|---|
| Channel number | A unique identifier for the channel | 0 | 2 | UInt32 |
| Channel quantity | The type of measurement represented by this channel. Examples include length, temperature and voltage. | 4 | 4 | UInt32 |
| Channel units | The default measurement units to be used | 8 | 4 | UInt32 |
| Units string | A string representation of the default units | 12 | 64 | String |
| Flags | Binary values to determine how to convert and display the data (see below). | 76 | 4 | UInt32 |
| Interval | Approximate time between readings, based on the frequency of the CAN packet that carries this channel. | 80 | 8 | Time-stamp |
| Minimum reading | The lowest possible reading, in raw values, as specified by the vehicle manufacturer. | 88 | 4 | Int32 |
| Maximum reading | The highest possible reading, in raw values, as specified by the vehicle manufacturer. | 92 | 4 | Int32 |
| Display minimum | The lowest possible reading, in display units. | 96 | 8 | Float64 |
| Display maximum | The highest possible reading, in display units. | 104 | 8 | Float64 |
| Multiplier | A multiplier for converting from raw to display values. | 112 | 8 | Float64 |
| Offset | An offset for converting from raw to display values. | 120 | 8 | Float64 |
| Channel name | A textual identifier for the channel | 128 | 64 | String |
| Channel description | A user-friendly description of the channel | 192 | 256 | String |

The meaning of certain bits in the Flags field is explained in Table 8.

TABLE 8

The Flags field.

| Bit | Meaning when set |
|---|---|
| 0 | Visible by default. |
| 1 | Linear conversion to measurement units is possible. |
| 2 | Interpolation permitted. |

When bit 1 is set, the raw channel values can be converted to the corresponding measurement unit by applying the formula: Converted value=Multiplier×Raw value+Offset. Otherwise, a unity conversion is assumed. When bit 2 is set, it is valid to interpolate between sample values. Otherwise, no interpolation should occur.

Figure 5:
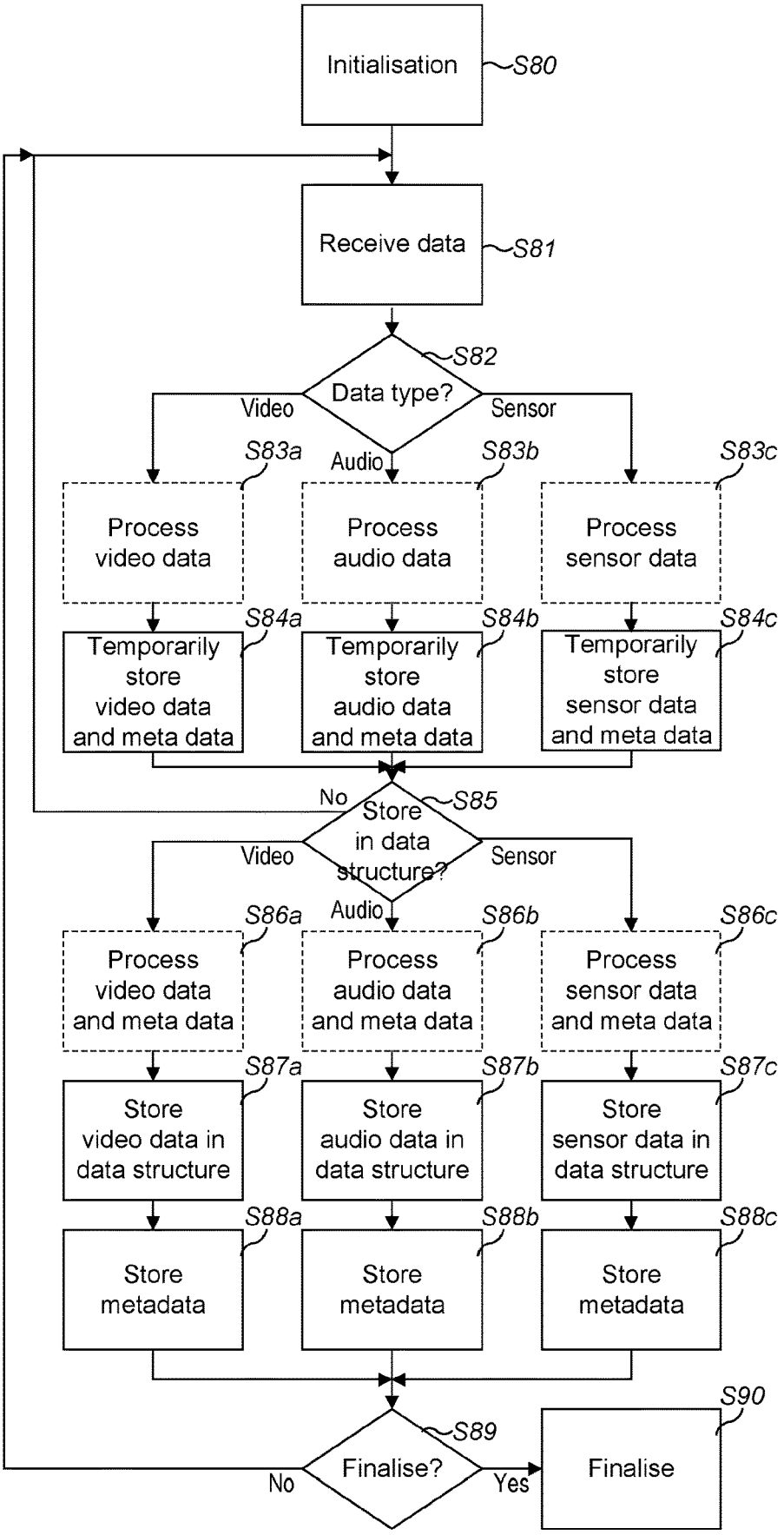
FIG. 5 illustrates certain operations which may be performed by a data processor in the system of FIG. 1.

Referring particularly to FIG. 5, certain operations which can be performed by the data processor 5 will now be described in more detail.

At step S80, the data processor 5 initialises. This step may be performed in response to a user input via the user interface 10. The initialisation may involve initiating several data structures, including the data structure 20, storing certain metadata 21, communicating with one or more of the sensors 8 and/or communicating with a user via the user interface 10.

At step S81, data is received from one (or more) of the sensors 8 via the interface 54.

At step S82, the type of data received is determined. If the data corresponds to video data 22, then the method proceeds to step S83*a*. If the data corresponds to audio data 23, then the method proceeds to step S83*b*. If the data corresponds to sensor data 24, then the method proceeds to step S83*c*.

At step S83*a*, the data corresponding to video data 23 is processed. For example, the data may be encoded or re-encoded into a suitable format, e.g. AVC format. In certain embodiments, the processing of the data may alternatively or additionally be carried out at step S86*a*.

At step S84*a*, the video data 22 and associated metadata 21, including e.g. timing information, is temporarily stored, for example in the volatile memory 52. The method then proceeds to step S85.

At step S83*b*, the data corresponding to the audio data 23 is processed. For example, the data may be encoded or re-encoded into a suitable format, e.g. AAC format. In certain embodiments, the processing of the data may alternatively or additionally be carried out at step S86*b*.

At step S84*b*, the audio data 23 and associated metadata 21, including e.g. timing information, is temporarily stored, for example in the volatile memory 52. The method then proceeds to step S85.

At step S83*c*, the data corresponding to the sensor data 24 is processed. For example, the data may be used to form a reading 63 (see FIG. 2*c*). This may involve assigning a channel number based, for example, upon the sensor 8 from which the data was received. Forming a reading 63 may also involve generating timing information in the form of a timestamp. The same clock and/or timing reference is preferably used to generate the timing information for the sensor data 24 as that used for the video data 22 and audio data 24. Forming a reading 63 may also involve processing and re-formatting the data received from the sensor 8. In certain embodiments, the processing of the data may alternatively or additionally be carried out at step S86*c*. There is no need to separate readings 63 associated with different channels numbers.

At step S84*c*, the sensor data 24 and associated metadata 21 is temporarily stored, for example in the volatile memory 52. The method then proceeds to step S85.

At step S85, it is determined whether video data 22, audio data 23 or sensor data 24 is to be stored in the data structure 20 or no data is to be stored. This can be based on timing information or upon the amount of data temporarily stored. If video data 22 is to be stored in the data structure 20, then the method proceeds to step S86*a*. If audio data 23 is to be stored in the data structure 20, then the method proceeds to step S86*b*. If sensor data 24 is to be stored in the data structure 20, then the method proceeds to step S86*c*. If no data is to be stored, then the method returns to step S81.

At step S86*a*, 86*b* or 86*c*, any further processing of the video data 22, audio data 23 or sensor data 24 is performed.

At step S87*a*, 87*b* or 87*c*, a discrete portion 25 of the video data 22, audio data 23 or sensor data is stored in the data structure 20.

At step S88*a*, 88*b* or 88*c*, associated metadata 21 is stored in the data structure 20.

At step S89, it is determined whether the data structure 20 is to be finalised. If so, then the method proceeds to step S90. If not, then the method returns to step S81.

At step S90, the data structure 20 is finalised, for example by storing (or moving) the metadata 21 in the Movie box $\mathbf{30}_3$ in the data structure 20.

Figure 6:
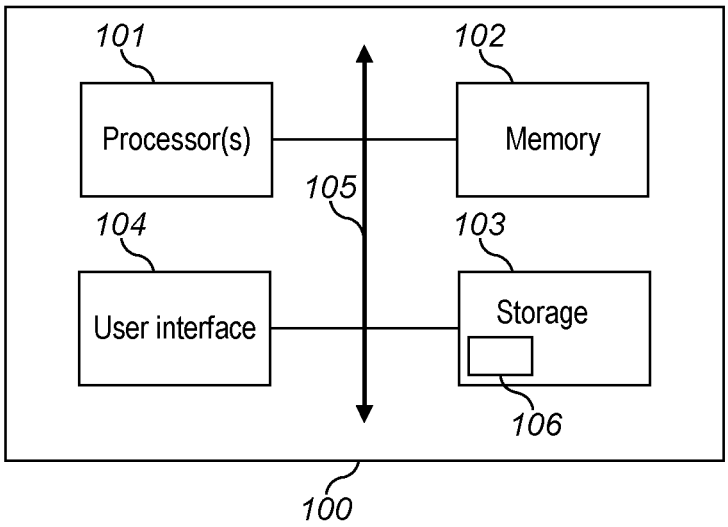
FIG. 6 illustrates apparatus for displaying data associated with a vehicle.

Referring particularly to FIG. 6, apparatus 100 according to a certain embodiment of the present invention will now be described. The apparatus 100 may correspond to a computer. The apparatus 100 includes one or more processors 101, memory 102, storage 103, and a user interface 104. The memory 102 includes volatile and/or non-volatile memory. The storage 103 includes, for example, a hard disk drive and/or a flash memory storage device reader. The user interface 104 preferably includes one or more user inputs, e.g. a keyboard, a mouse and/or a touch-sensitive screen, and one or more user outputs, including a display. The one or more processors 101, memory 102, storage 103 and user interface 104 communicate with one another via a bus or other form of interconnection 105. The one or more processors 101 execute computer-readable instructions 106, e.g. one or more computer programs, for performing certain methods described herein. The computer-readable instructions 106 may be stored in the storage 103.

As will be explained in more detail below, the apparatus 100 is configured to display data from first and second sets of data associated with a vehicle. The first and second sets of data are each preferably obtained and structured as described above with reference to FIGS. 1 to 5. The first and second sets of data each include video data and GPS (or other positioning) data, and preferably each include audio data and other sensor data. Display of the data preferably includes playback of video data and a corresponding time-varying display of sensor data or related data, e.g. timing information. Display of the data is hereinafter referred to as "playback" of the data.

The apparatus 100 is configured to control playback of the data from the first or second set of data in dependence upon the positioning data in the first and second sets of data. This is done such that the data from the first and second sets of data which is displayed at a particular time relates to equivalent positions of the vehicle or vehicles with which the first and second data are associated. For example, the effective playback rate of the data from the first or second set of data is increased or decreased relative to the other to compensate for the vehicle or vehicles taking different lengths of time to move between equivalent positions. Controlling the playback of the data in this way is hereinafter referred to as "playback alignment". The vehicle with which the first set of data is associated is hereinafter referred to as the "first vehicle" and the vehicle with which the second set of data is associated is hereinafter referred to as the "second vehicle", although, as will be appreciated, the first and second vehicles may be the same vehicle.

Figure 7:
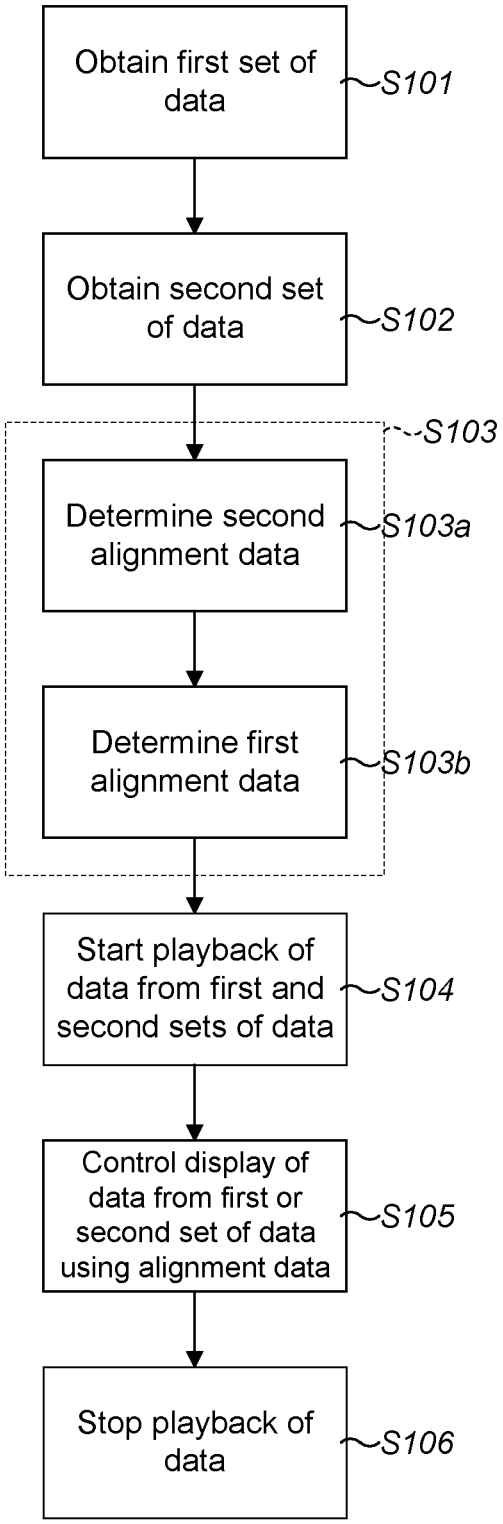
FIG. 7 illustrates certain operations which may be performed by the apparatus of FIG. 6.

Referring particularly to FIG. 7, certain operations which can be performed by the apparatus 100 will now be described.

At steps S101 and S102 respectively, the first and second sets of data are obtained. This may involve transferring the sets of data from the storage 103 into the memory 102. Preferably, a user can select the sets of data to be obtained via the user interface 104. The sets of data may be restructured as appropriate, e.g. to facilitate access to the data.

The second set of data may correspond to part of a larger set of data. In particular, the second set of data may correspond to a particular lap of a number of laps around a circuit. In this case, when a set of data including a number of laps is selected by a user, the first lap of the selected set of data is preferably used as the second set of data. Preferably, a user can change the lap to be used as the second set of data via the user interface 104.

At step S103, data for facilitating the playback alignment (hereinafter referred to as "alignment data") is determined. This step is preferably carried out whenever a second set of data is obtained or a first or second set of data is changed. The step may involve checking that the first and second sets of data are comparable, e.g. relate to the same circuit.

In this example, the alignment data takes the form of an array of map distances and respective timing information, i.e. respective timestamps. The alignment data is preferably formatted in the same way as the abovedescribed channels, except that the alignment data need not include channel numbers. The timestamps in the alignment data correspond to, e.g. use the same time reference as, the timing information for the data, e.g. video and GPS data, included in the first and second sets of data. The alignment data is preferably stored in the memory 102

At step S103*a*, the alignment data for the second set of data (hereinafter referred to as "second alignment data") is determined. The map distances for the second alignment data (hereinafter referred to as "second map distances") correspond to the distance travelled by the second vehicle from a defined start point, e.g. the start of the lap. The second map distances are preferably determined from the GPS data included in the second set of data. The GPS data, e.g. latitude and longitude readings, may be converted to local X, Y coordinates to facilitate this. The positions determined from the GPS data are hereinafter referred to as "recorded positions". The second map distances are preferably determined for each recorded position of the second vehicle, i.e. at the same timestamps as the GPS readings. Each second map distance (other than the first, which is zero) is preferably determined from the previous second map distance by adding the straight-line distance between the current and previous recorded positions of the second vehicle.

At step S103*b*, the alignment data for the first set of data (hereinafter referred to as "first alignment data") is determined. The map distances for the first alignment data (hereinafter referred to as "first map distances") are determined such that when the first and second vehicles are at equivalent positions (which is not generally at the same time), the first and second map distances are the same.

Figure 8:
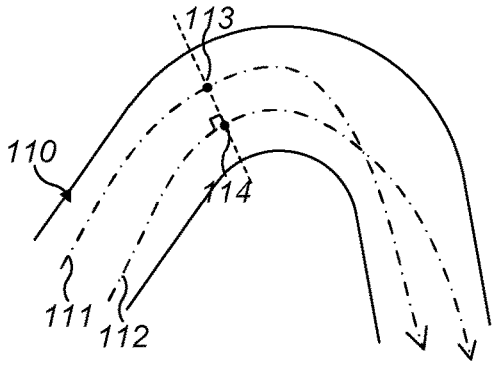
FIG. 8 illustrates equivalent positions of a vehicle or vehicles.

Referring also to FIG. 8, the equivalent positions will now be described in more detail. The figure illustrates a section of track 110 and paths 111, 112 taken by the first and second vehicles around the section of track 110. The first and second vehicles are considered to be at equivalent positions 113, 114 when the position 113 of the first vehicle is substantially on the same line 115 (in the X-Y plane) as the position 114 of the second vehicle, wherein the line 115 is perpendicular to the direction of movement (e.g. the heading) of the second vehicle at the position 114.

Preferably, for each recorded position of the second vehicle and corresponding second map distance, an equivalent position of the first vehicle is determined. The equivalent position may be determined to be the recorded position of the first vehicle which is closest to the line 115. However the equivalent position is preferably obtained by extrapolation or interpolation based upon the one or two recorded positions of the first vehicle which is or are closest to the line 115. The recorded positions of the first and second vehicles are illustrated by the dots in the dash-dot lines 111, 112 in the figure. The second map distance is then stored in the first alignment data with a timestamp that corresponds to the timestamp associated with the closest recorded position of the first vehicle or, as the case may be, a timestamp obtained by extrapolation or interpolation.

When determining which recorded position(s) of the first vehicle should be used as, or to determine, the equivalent position, information about the distances travelled by the first and second vehicles since the last known equivalent positions may be used. For example, this information may be used to determine a weighting to distinguish between recorded positions of the first vehicle which are similarly close to the line 115, but which relate to different points on the path 111 taken by the first vehicle, e.g. at the start or end of a lap or the entry or exit to or from a hairpin corner.

In other examples, the alignment data may be determined differently. For example, the alignment data for the first set of data may be determined according to the abovedescribed principle for determining equivalent positions but using a different algorithm. The principle for determining equivalent positions may be different, e.g. it may involve using information about the track. The alignment data may be different.

At step S104, playback of the data is started. This may be in response to a user input via the user interface 104. Preferably, the user is able to select which of the first and second sets of data is played back at a constant rate, e.g. in real-time, and which is played back at a variable rate. The following description is provided for the case where the second set of data is played back at a constant rate and the first set of data is played back at a variable rate.

At step S105, data from the first and second sets of data is played back. The effective playback rate of data from the second set of data is preferably controlled using a clock. The effective playback rate of data from the first set of data is varied using the alignment data. In particular, as data from the second set of data is played back, map distances are obtained from the second alignment data, equivalent map distances are found in the first alignment data, and the timestamps associated therewith are used to determine which data from the first set of data are to be displayed. Accordingly, for example, the frame rate of the video data from the first set of data may be increased or decreased and/or frames of the video data from the first set of data may be repeated or omitted as appropriate.

Figure 9:
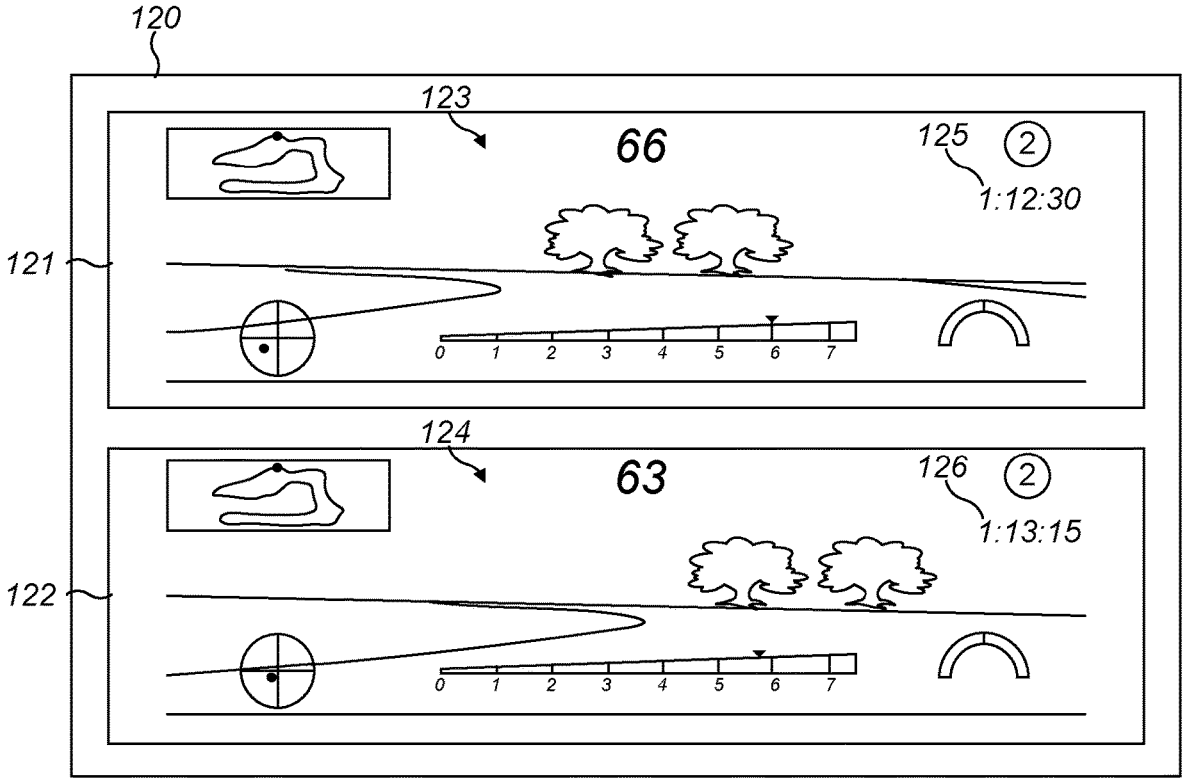
FIG. 9 illustrates an example display provided by the apparatus of FIG. 6.

Referring also to FIG. 9, an example display 120 provided by the user interface 104 will now be described. The display 120 includes first and second display regions 121, 122 for displaying data from the first and second sets of data, respectively. As can be seen e.g. from the video images 123, 124, the first and second vehicles are at equivalent positions, whereas the times 125, 126 since e.g. the beginning of the lap are different from each other, as are the distances travelled by the first and second vehicles. Thus, data associated with the first and second vehicles is displayed at equivalent positions of the first and second vehicles, thereby facilitating comparisons therebetween.

At step S106, playback of the data is stopped. This may be in response to a user input via the user interface 104.

Various further operations (not shown in the figure) may be performed in response to various user inputs via the user interface 104.

For example, playback of data from the second set of data may be "scrubbed", that is to say caused to play back more quickly or more slowly than real-time, or stepped forwards or backwards in time. In such cases, playback of data from the first set of data is controlled appropriately to maintain the playback alignment as described above.

Playback of the data may be re-started, in which case the process returns to step S104. The same or the other one of the first and second sets of data may be played back at a constant rate.

A different second set of data may be obtained, in which case the process returns to step S102. A different first set of data may be obtained, in which case the process returns to step S101 and, after this step, proceeds to step S103.

It will be appreciated that many other modifications may be made to the embodiments hereinbefore described.

For example, one or more parts of the system 1 may be remote from the vehicle.

The invention claimed is:

1. A method comprising:

obtaining first data associated with a vehicle, the first data comprising positioning data indicative of positioning of the vehicle and video data from a camera associated with the vehicle and indicative of a point of view from the vehicle;

obtaining second data associated with the vehicle or with another vehicle, the second data comprising positioning data indicative of the positioning of the vehicle or positioning of the other vehicle and video data from the camera associated with the vehicle indicative of the point of view from the vehicle or from a camera associated with the other vehicle indicative of a point of view from the other vehicle;

determining alignment data for the second data, the alignment data comprising an array of map distances and respective timing information, the map distance corresponding to a distance travelled from a defined start point;

determining alignment data for the first set of data such that when the first and second vehicles are at equivalent positions the map distances for the first and second vehicles are the same; and causing at least some of the video data comprised in the first data and at least some of the video data comprised in the second data to be displayed, an effective playback rate of data from the second data being controlled using a clock and an effective playback rate of data from the first data is varied using the alignment data such that the video data from the first data and the video data from the second data are displayed simultaneously and are associated, respectively, with different points in time.

2. The method according to claim 1, wherein the vehicle or the vehicle and the other vehicle are at equivalent positions when positioned on substantially a same line, preferably wherein the line is substantially perpendicular to a direction of movement of the vehicle with which the second data are associated, at one or more times before the particular time.

3. The method according to claim 1, wherein determining equivalent positions comprises extrapolating or interpolating based on one or more recorded positions of the vehicle with which the first data are associated.

4. The method according to claim 1, wherein determining equivalent positions comprises using information about the distances travelled by the vehicle or by the vehicle and the other vehicle since previous equivalent positions.

5. The method according to claim 1, comprising:

parameterising a path taken by the vehicle with which the second data are associated; and parameterising a path taken by the vehicle with which the first data are associated such that, when the vehicle, the other vehicle, or both the vehicle and the other vehicle are at equivalent positions, the parameters used to parameterise the paths taken by the vehicle, the other vehicle, or both the vehicle and the other vehicle are substantially equal.

6. The method according to claim 5, wherein parameterising the path taken by the vehicle with which the second data are associated comprises determining a distance travelled by the vehicle with which the second data are associated as a function of time.

7. The method according to claim 6, wherein parameterizing the path taken by the vehicle with which the first data are associated comprises, for each of a set of distances travelled by the vehicle with which the second data are associated:

determining a time at which the vehicle with which the first data are associated is at an equivalent position to the vehicle with which the second data are associated; and associating the distance travelled by the vehicle with which the second data are associated with the determined time.

8. The method according to claim 5, wherein controlling display of the first data comprises:

determining a parameter of the path taken by the vehicle associated with the second data at a particular time;

determining a time at which the parameter of the path taken by the vehicle associated with the first data is substantially equal to the determined parameter; and displaying first data corresponding to the determined time.

9. The method according to claim 5, wherein controlling display of the second data comprises:

determining a parameter of the path taken by the vehicle associated with the first data at a particular time;

determining a time at which the parameter of the path taken by the vehicle associated with the second data is substantially equal to the determined parameter; and displaying second data corresponding to the determined time.

10. The method according to claim 1, wherein display of the first or second data is controlled in dependence upon a user input selecting the first or second data.

11. A non-transitory computer-readable storage medium storing a computer program for performing a method comprising:

obtaining first data associated with a vehicle, the first data comprising positioning data indicative of positioning of the vehicle and video data from a camera associated with the vehicle and indicative of a point of view from the vehicle;

obtaining second data associated with the vehicle or with another vehicle, the second data comprising positioning data indicative of the positioning of the vehicle or positioning of the other vehicle and video data from the camera associated with the vehicle indicative of the point of view from the vehicle or from a camera associated with the other vehicle indicative of a point of view from the other vehicle;

determining alignment data for the second data, the alignment data comprising an array of map distances and respective timing information, the map distance corresponding a distance travelled from a defined start point;

determining alignment data for the first data such that when the first and second vehicle are at equivalent positions the map distances for the first and second vehicles are the same; and causing at least some of the video that is displayed at a particular time relates to equivalent positions of video data comprised in the first data and at least some of the video data comprised in the second data to be displayed, an effective playback rate of data from the second data being controlled using a clock and an effective playback rate of data from the first data is varied using the alignment data such that the video data from the first data and the video data from the second data are displayed simultaneously and are associated, respectively, with different points in time.

12. Apparatus configured to:

obtain first data associated with a vehicle, the first data comprising position data indicative of positioning of the vehicle and video data from a camera associated with the vehicle and indicative of a point of view from the vehicle;

obtain second data associated with the vehicle or with another vehicle, the second data comprising positioning data indicative of the positioning of the vehicle or positioning of the other vehicle and video data from the camera associated with the vehicle indicative of the point of view from the vehicle or from a camera associated with the other vehicle indicative of a point of view from the other vehicle;

determine alignment data for the second data, the alignment data comprising an array of map distances and respective timing information, the map distance corresponding to a distance travelled from a defined start point; determine alignment data for the first data such that when the first and second vehicles are at equivalent positions the map distances for the first and second vehicles are the same; and cause at least some of the video data comprised in the first data and at least some of the video data comprised in the second data to be displayed, wherein an effective playback rate of data from the second data is controlled using a clock and an effective playback rate of data from the first data is varied using the alignment data such that the video data from the first data and the video data from the second data are displayed simultaneously and are associated, respectively, with different points in time.

13. The apparatus according to claim 12, wherein the vehicle or the vehicle and the other vehicle are at equivalent positions when positioned on substantially a same line, preferably wherein the line is substantially perpendicular to a direction of movement of the vehicle with which the second data are associated, at one or more times before the particular time.

14. The apparatus according to claim 12, configured to determine the equivalent positions by extrapolating or interpolating based on one or more recorded positions of the vehicle with which the first data are associated.

15. The apparatus according to claim 12, configured to determine the equivalent positions by using information about the distances travelled by the vehicle or the vehicle and the other vehicle since previous equivalent positions.

16. The apparatus according to claim 12, configured to:

parameterise a path taken by the vehicle with which the second data are associated; and parameterise a path taken by the vehicle with which the first data are associated such that, when the vehicle or the vehicle and the other vehicle are at equivalent positions, the parameters used to parameterise the paths taken by the vehicle or vehicles are substantially equal.

17. The apparatus according to claim 16, configured to parameterise the path taken by the vehicle with which the second data are associated by determining a distance travelled by the vehicle with which the second data are associated as a function of time.

18. The apparatus according to claim 17, configured to parameterise the path taken by the vehicle with which the first data are associated by, for each of a set of distances travelled by the vehicle with which the second data are associated:

determining a time at which the vehicle with which the first data are associated is at an equivalent position to the vehicle with which the second data are associated; and associating the distance travelled by the vehicle with which the second data are associated with the determined time.

19. The apparatus according to claim 16, configured to control display of the first data by:

determining a parameter of the path taken by the vehicle associated with the second data at a particular time;

determining a time at which the parameter of the path taken by the vehicle associated with the first data is substantially equal to the determined parameter; and displaying first data corresponding to the determined time.

20. The apparatus according to claim 16, configured to control display of the second data by:

determining a parameter of the path taken by the vehicle associated with the first data at a particular time;

determining a time at which the parameter of the path taken by the vehicle associated with the second data is substantially equal to the determined parameter; and displaying second data corresponding to the determined time.

* * * * *